US010975449B2

(12) United States Patent
Kenning

(10) Patent No.: US 10,975,449 B2
(45) Date of Patent: Apr. 13, 2021

(54) MUD GUN CAP

(71) Applicant: J. C K. Industries, Inc., Huron, OH (US)

(72) Inventor: Jack C. Kenning, Sandusky, OH (US)

(73) Assignee: J. C K. Industries, Inc., Huron, OH (US)

( * ) Notice: Subject to any disclaimer, the term of this patent is extended or adjusted under 35 U.S.C. 154(b) by 71 days.

(21) Appl. No.: 16/395,735

(22) Filed: Apr. 26, 2019

(65) Prior Publication Data

US 2019/0345574 A1 Nov. 14, 2019

Related U.S. Application Data

(60) Provisional application No. 62/670,288, filed on May 11, 2018.

(51) Int. Cl.

| | |
|---|---|
| ***C21B 7/12*** | (2006.01) |
| ***F27D 3/15*** | (2006.01) |
| ***C21C 5/46*** | (2006.01) |

(52) U.S. Cl.

CPC ..... *C21B 7/12* (2013.01); *C21C 5/4653* (2013.01); *F27D 3/1536* (2013.01)

(58) Field of Classification Search

CPC ..... C21B 7/12; C21B 7/125; C21C 5/4653; F27D 3/1536; F27D 3/15

See application file for complete search history.

(56) References Cited

U.S. PATENT DOCUMENTS

| | | | | |
|---|---|---|---|---|
| 4,135,705 | A * | 1/1979 | Mailliet | C21B 7/12 266/273 |
| 5,346,186 | A * | 9/1994 | Given | C21B 7/12 266/270 |
| 7,583,254 | B2 | 9/2009 | Kenning et al. | |
| 8,083,988 | B2 | 12/2011 | Kenning et al. | |
| 2007/0262499 | A1* | 11/2007 | Kenning | C21B 7/12 266/273 |
| 2010/0019421 | A1* | 1/2010 | Kenning | C21B 7/12 266/45 |
| 2019/0345574 | A1* | 11/2019 | Kenning | C21B 7/125 |

FOREIGN PATENT DOCUMENTS

CN 202688348 U * 1/2013

OTHER PUBLICATIONS

English Language translation of CN-202688348-U Jan. 2013.*

* cited by examiner

*Primary Examiner* — Scott R Kastler

(74) *Attorney, Agent, or Firm* — Calfee, Halter & Griswold LLP

(57) ABSTRACT

Exemplary embodiments of mud gun caps are disclosed herein. An exemplary mud gun cap includes a flame-resistant body that has a tap hole contacting surface. The flame-resistant body has side wall; a first bore and a second bore located within the flame-resistant body. The first bore has a first diameter and second bore has a second diameter. The first diameter is smaller than the second diameter and the second bore is located farther away from the tap hole contacting surface than the first bore.

11 Claims, 7 Drawing Sheets

MUD GUN CAP

RELATED APPLICATIONS

This application claims priority to and the benefits of U.S. Provisional Patent Application Ser. No. 62/670,288, which was filed on May 11, 2018 and which was entitled MUD GUN CAP, and which is incorporated herein by reference in its entirety.

FIELD OF USE

This invention relates generally to blast furnace iron making operations and more particularly to a mud gun cap for the nozzle of a mud gun.

BACKGROUND

Raw materials, including iron ore, limestone, and coke are added to a blast furnace where they are heated. As the raw materials are heated, molten iron forms at the bottom of the blast furnace and a layer of slag forms on top of the molten iron. After a sufficient volume of molten iron builds up at the bottom of the blast furnace, the blast furnace is tapped to remove the molten iron. A tap drill is used to tap the blast furnace by drilling out the tap hole. As the tap drill is removed, molten iron flows through the tap hole into a trough where it is routed to a waiting rail car.

After the molten iron is drained out of the blast furnace, or after a desired amount of iron has been drained from the blast furnace, the tap hole is sealed. The tap hole is sealed with a mud gun. An anhydrous mixture, commonly referred to as "mud" or "clay" is loaded into the mud gun. The mud gun rotates from a non-operating or resting position to its operating position. In its operating position the mud gun is positioned so that the nozzle 110 (FIG. 1) of the mud gun (not shown) is aligned with the tap hole 130. Mud 170 is extruded through the nozzle 110 and forced into the tap hole 130. The mud 170 forces the residual molten iron 160 and slag 150 that is in the tap hole 130 back inside the furnace 140. Inevitably, however, not all of the iron 160 and slag 150 is pushed back into the furnace 140 i.e., some of the iron 160 or slag 150 remains in the tap hole 130 and mixes with the mud 170 forming a mud and ore residue 180. The mud gun nozzle 110 remains in place until the mud 170 dries or cures. After the mud 170 is cured, the mud gun is rotated back away from the blast furnace 140.

The mud and ore residue 180 in the tap hole 130 cause binding and wear on the tap drill (not shown) during the subsequent tapping of the blast furnace 140. In addition, the mud and ore residue 180 causes the drill to "walk" resulting in an irregular shaped, or oversized hole. This is undesirable because, among other things, the size of the drilled hole controls the speed of the flow of molten iron 160 out of the blast furnace.

In addition, as the nozzle 110 nears the tap hole 130, the nozzle 110 comes into contact with the molten iron 130 and slag 150. Overtime, the tip of the nozzle 110 deteriorates and the mud gun nozzle 110 must be replaced. The deterioration is often referred to as rat toothing, because the lower portion of the nozzle tip which routinely comes into contact with the molten iron 160 is eroded faster than the upper potion of the nozzle tip which occasionally comes into contact with the molten iron. Replacement of the mud gun nozzle 110 is expensive and time consuming.

In operation, prior to rotating the mud gun into position to plug the tap hole 130, the operator ensures that the mud 170 is at the end of the nozzle 110. Mud 170 at the end of the nozzle 110 prevents molten iron 160 from entering and deteriorating the interior of nozzle 110 when the mud gun is rotated into position. However, as the mud gun rotates into position, mud 170 occasionally falls out of the nozzle 110 and into the trough 120. The mud 170 contacts the molten iron 160 and slag 150 and creates black smoke and may cause splashing of the molten iron 160. This smoke often results in the environmental protection agency (EPA) issuing a fine to the steel manufacturer.

The novel mud gun cap disclosed herein is an improvement over Applicants prior art mud gun cap is disclosed in U.S. Pat. No. 8,083,988.

SUMMARY

Exemplary embodiments of mud gun caps are disclosed herein. An exemplary mud gun cap includes a flame-resistant body that has a tap hole contacting surface. The flame-resistant body has side wall; a first bore and a second bore located within the flame-resistant body. The first bore has a first diameter and second bore has a second diameter. The first diameter is smaller than the second diameter and the second bore is located farther away from the tap hole contacting surface than the first bore.

Exemplary methods of making a mud gun cap are also disclosed herein. An exemplary methodology of making a mud gun cap includes providing a mud gun cap mold, providing a water bath and providing flame-resistant fibers. The methodology further includes drawing the flame-resistant fibers through the water bath into the mud gun cap mold, removing the mud gun cap mold from the water bath, drying the mud gun cap, and removing the mud gun cap from the mold.

Another exemplary mud gun cap includes a flame-resistant body. The flame-resistant body has a tap hole contacting surface and has side walls extending up from the contact surface at an angle of between about 15 degrees and about 50 degrees. A first bore is located within the flame-resistant body. The first bore is sized to fit over the tip of a mud gun nozzle and the mud gun cap is a molded from flame-resistant fibers having a rating of at least about 2600° Fahrenheit.

DETAILED DESCRIPTION

Figure 2:
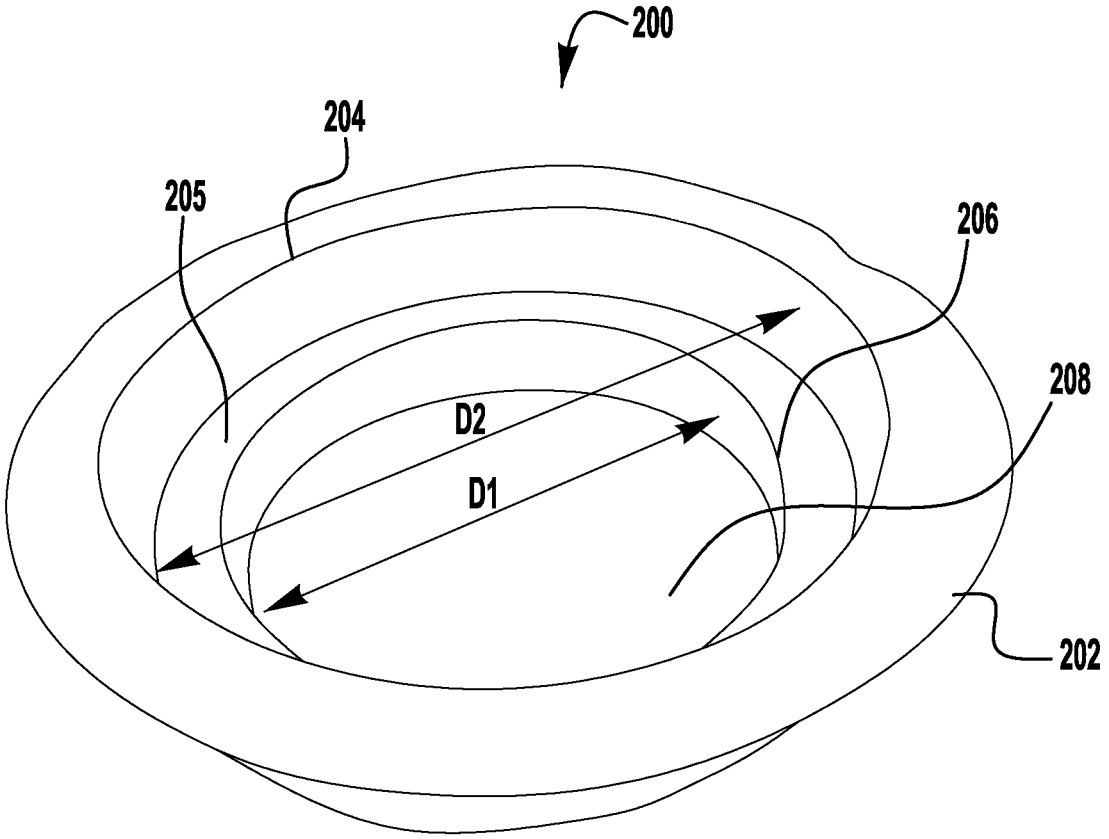
FIG. 2 is a top perspective view of an exemplar-embodiment of a mud gun cap.
Figure 3:
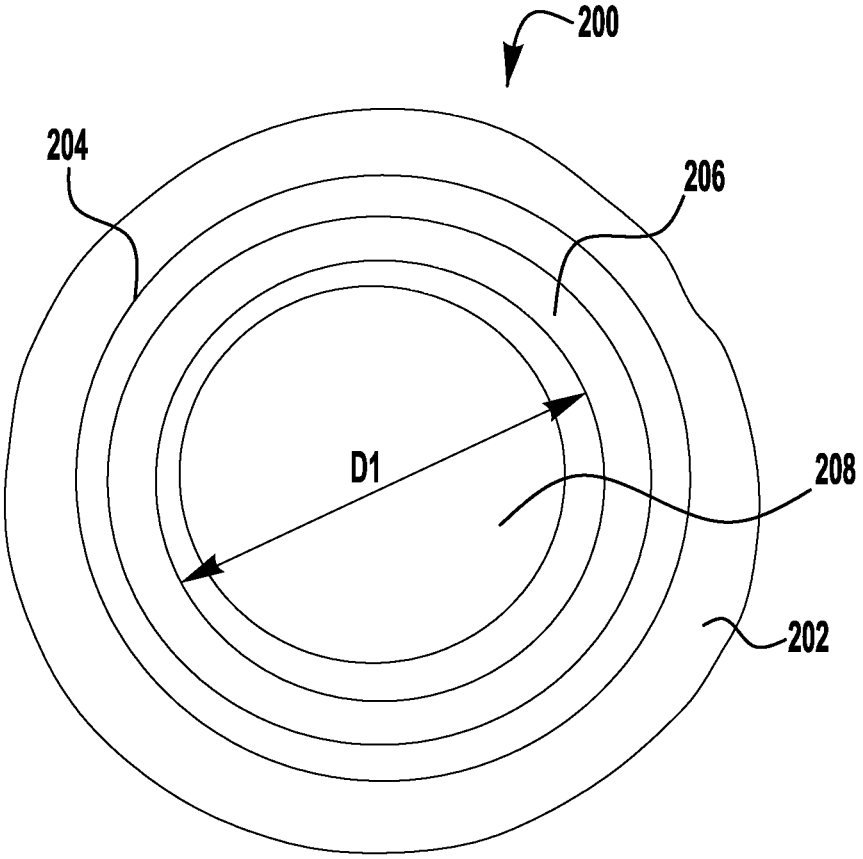
FIG. 3 is a top view of the mud gun cap of FIG. 2.
Figure 4:
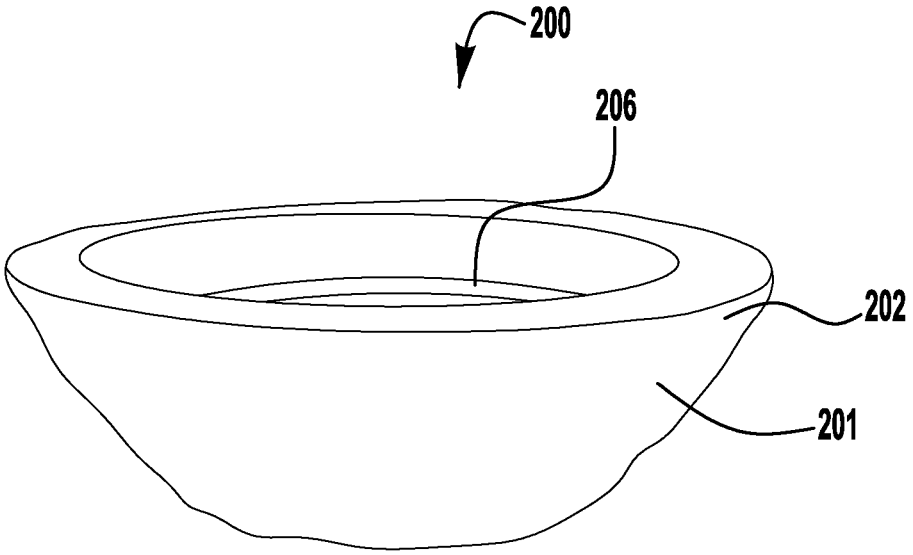
FIG. 4 is a side view of the mud gun cap of FIG. 2.

FIG. 2 and is a perspective view of an embodiment of a mud gun cap 200. FIG. 3 is a plan view of mud gun cap 200 and FIG. 4 is a side elevational view of mud gun cap 200. In some embodiments, the mud gun cap 200 is made of a flame-resistant fiber material, such as, for example, a 2600 or 2800 degree Fahrenheit fiber. In some embodiments, the fiber is a ceramic fiber.

Mud gun cap 200 is preferably a single molded unit made up of the flame-resistant fiber material. Mud gun cap 200 includes side wall 201. Side wall 201 is configured to enclose the end portion of the mud gun nozzle 110. In some embodiments, the side walls extend up and outward from the end surface at an angle of between about 15 and 65 degrees. In some embodiments, the side walls extend up and outward from the end surface at an angle of between about 20 and 50 degrees. In some embodiments, the side wall extends up and outward from the end surface at an angle of between about 25 and 45 degrees. The flame-resistant material surrounding the end portion of the mud gun nozzle 110 protects the tip of the mud gun nozzle 110. The side wall increases safety because it diffuses the iron flow and limits the splashing of iron when the mud gun nozzle 110 is rotated in position and placed in the flow path of the molten iron. In addition, the inventive mud gun cap 200 helps protect the integrity of the tap hole.

The interior of mud gun cap 200 includes a bottom surface 208, a first bore 206 and a second bore 204. The diameter D1 of first bore 206 is smaller than the diameter D2 of second bore 204. Located at the bottom of second bore is a shelf 205.

Figure 5A:
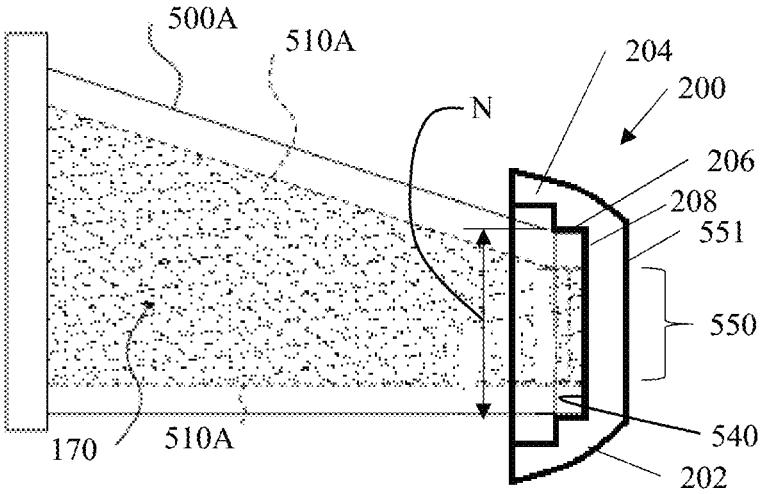
FIGS. 5A and 5B are a cross-sections of the mud gun cap secured to two different mud gun nozzles.
Figure 5B:
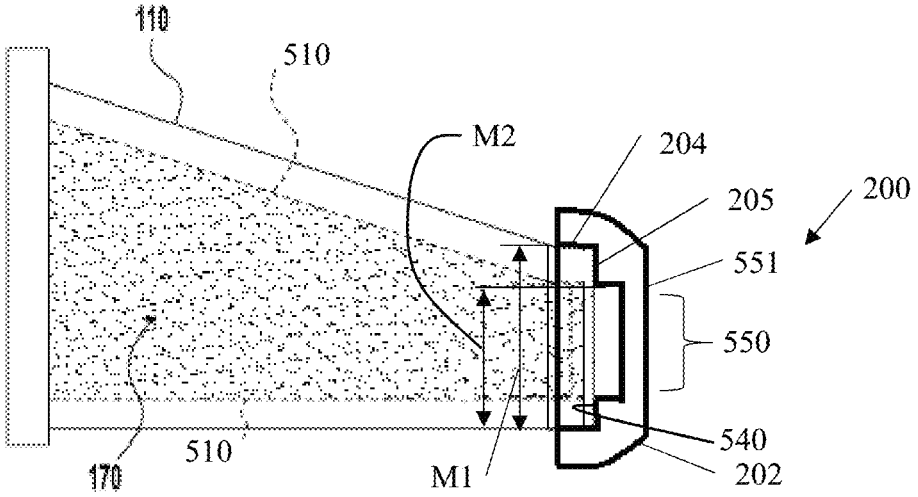
Figure 6:
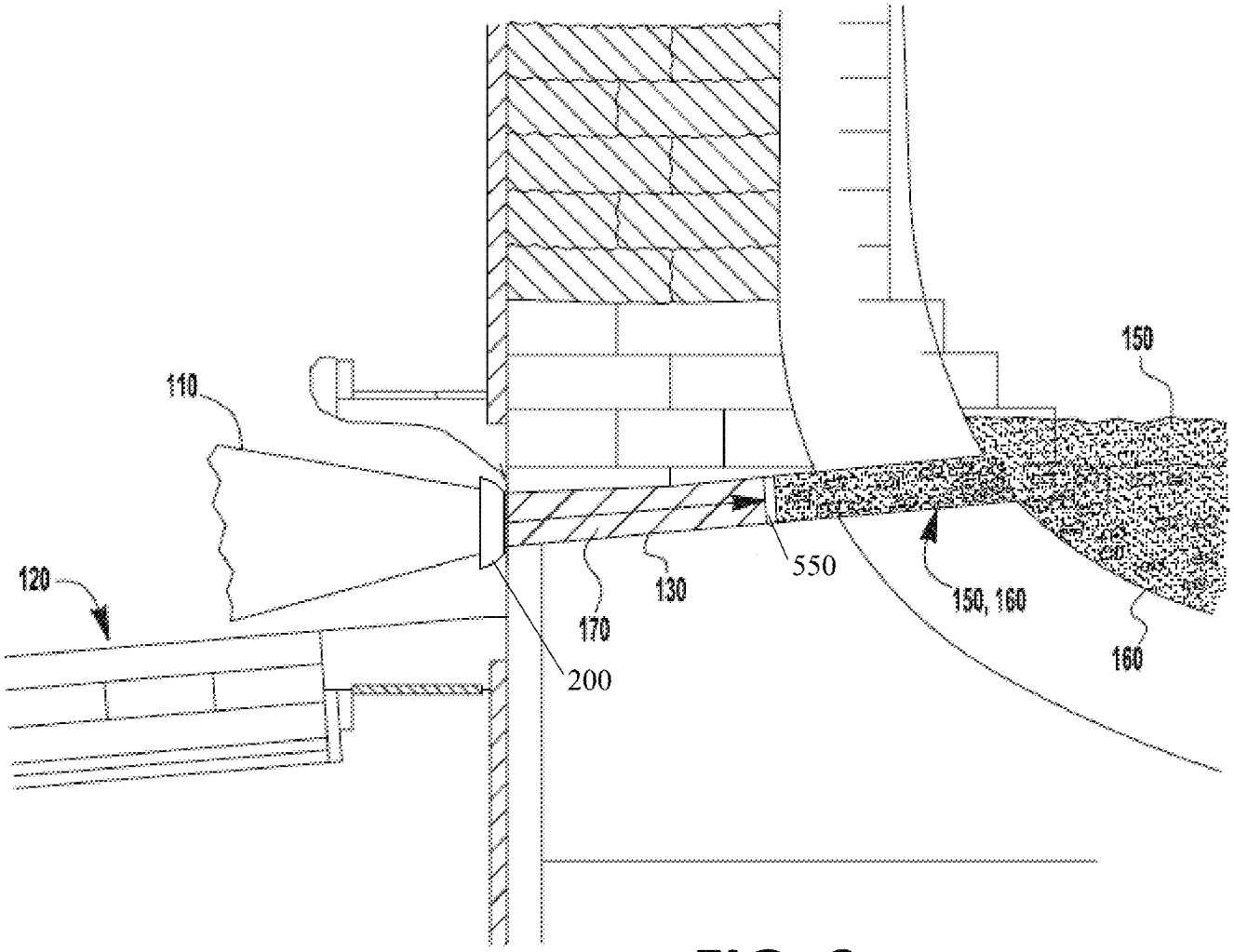
FIG. 6 is a cross-sectional view of a portion of a blast furnace, mud gun nozzle and a mud gun cap with mud injected into the tap hole and a portion of the mud gun cap progressing through the tap hole.

In some embodiments, the tip of mud gun nozzle 500A has an outside diameter of N (see FIG. 5A). The first bore of mud gun cap 200 has a diameter D1 that is slightly larger than the outside diameter N mud gun nozzle 500A and fits snuggly over the tip of mud gun nozzle 500A as shown in FIG. 5A. In some embodiments, the tip mud gun nozzle 500B has an outside diameter of M1, which is slightly smaller than the diameter D2 of second bore 204. Accordingly, second bore 204 fits snuggly over the tip of mud gun nozzle 500B. The inside diameter M2 of the tip of mud gun nozzle 500B is about the same size as the diameter D1 of first bore 206. Mud gun cap 200 includes a portion 550 on surface 551. As described below, in some embodiments, portion 550 is configured to break off of mud cap 200 and move up into the tap hole (not shown) due to the movement of the mud 170. In some embodiments, portion 550 is outline by perforations (not shown) allowing the portion 550 to more cleanly separate from mud gun cap 200. In some embodiments, portion 550 breaks to allow mud 170 to flow up into the tap hole. In some embodiments, perforations (not shown) control the breakage of portion 550. IN some embodiments, the perforations extend from the center of portion 550 outward.

Figure 7:
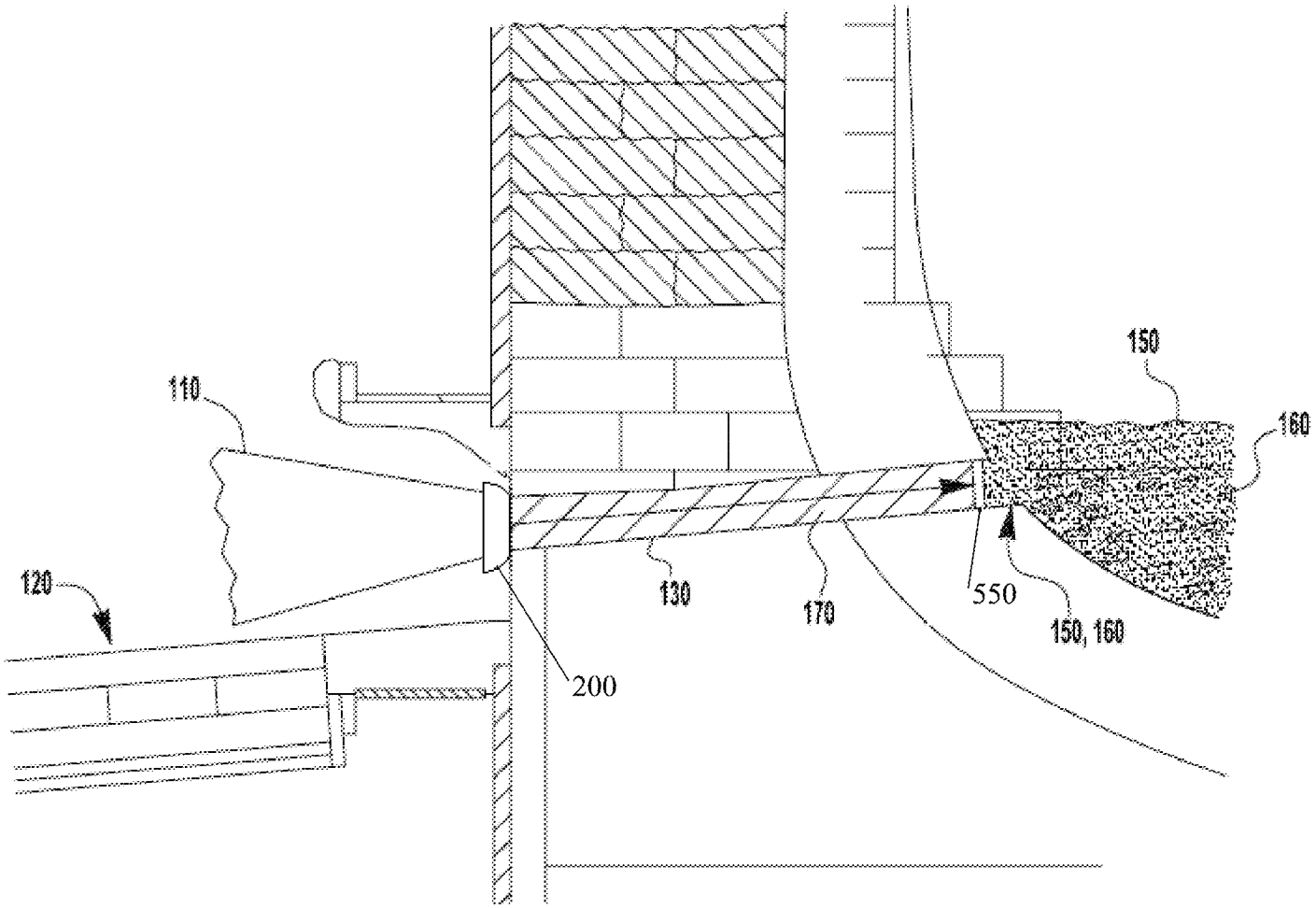
FIG. 7 is also a cross sectional view of a portion of the blast furnace, the mud gun nozzle and the mud gun cap with the mud fully injected and the portion of the mud gun cap near the end of the tap hole.
Figure 8:
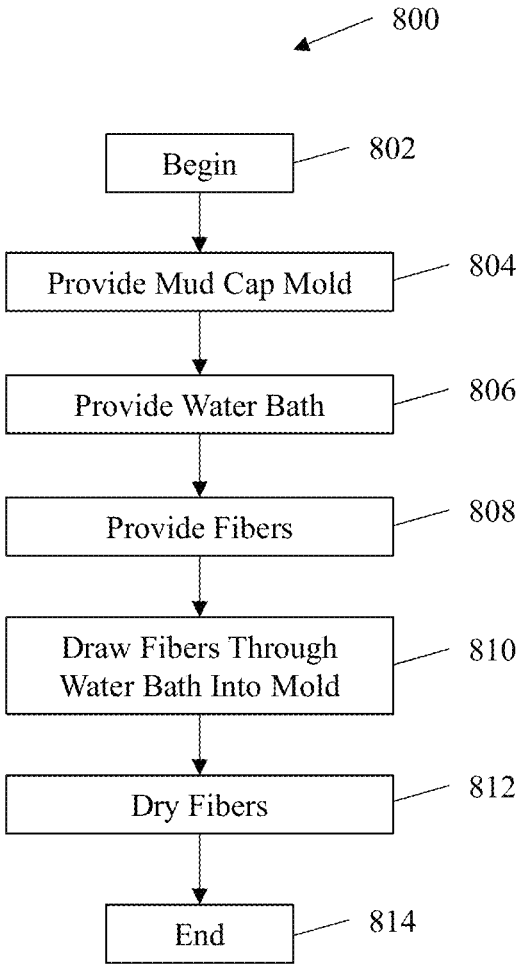
FIG. 8 is an exemplary methodology for producing a mud gun cap.

FIGS. 7 and 8 illustrate operation of a mud gun (not shown) having a mud gun cap 200 on the mud gun nozzle 110. The mud gun is rotated into position to plug the tap hole 130 of the blast furnace 140. As the mud gun is rotated into position, the outer face 551 of mud gun cap 200 comes into contact with the molten iron 160 flowing out of the tap hole 130. The outer face 551 and sides 201, which may be 2800 degree Fahrenheit fiber, protect the tip of the mud gun nozzle 110. As a result, use of the mud gun cap 200 extends the life of the mud gun nozzle 110 because the molten iron 160 does not come in contact with the mud gun nozzle 110 and cause deterioration. In addition, the mud gun cap 200 deflects the flow of molten iron 160 and limits splashing of the molten iron 160 as the mud gun nozzle 110 is rotated in place.

When the mud gun is rotated into position, the outer face 551 is pressed firmly against the tap hole 130. The mud gun is activated and forces mud 170 through the nozzle 110. The pressure exerted by the mud 170 causes the portion 550 to break or shear off allowing the mud 170 and, in some embodiments, the sheared off portion 550, to be forced up into the tap hole 130. In some embodiments, portion 550 fractures and remain secured to mud cap 200. Treatments, such as, for example, perforations, may be used to control the locations of the fractures so that the size and shape of the fractured portions of outer surface 551 are relatively predictable and whether or not the fragments of portion 550 remain attached to mud gun cap 200 or travel up the tap 130 along with the mud 170 is also predictable.

Figure 1:
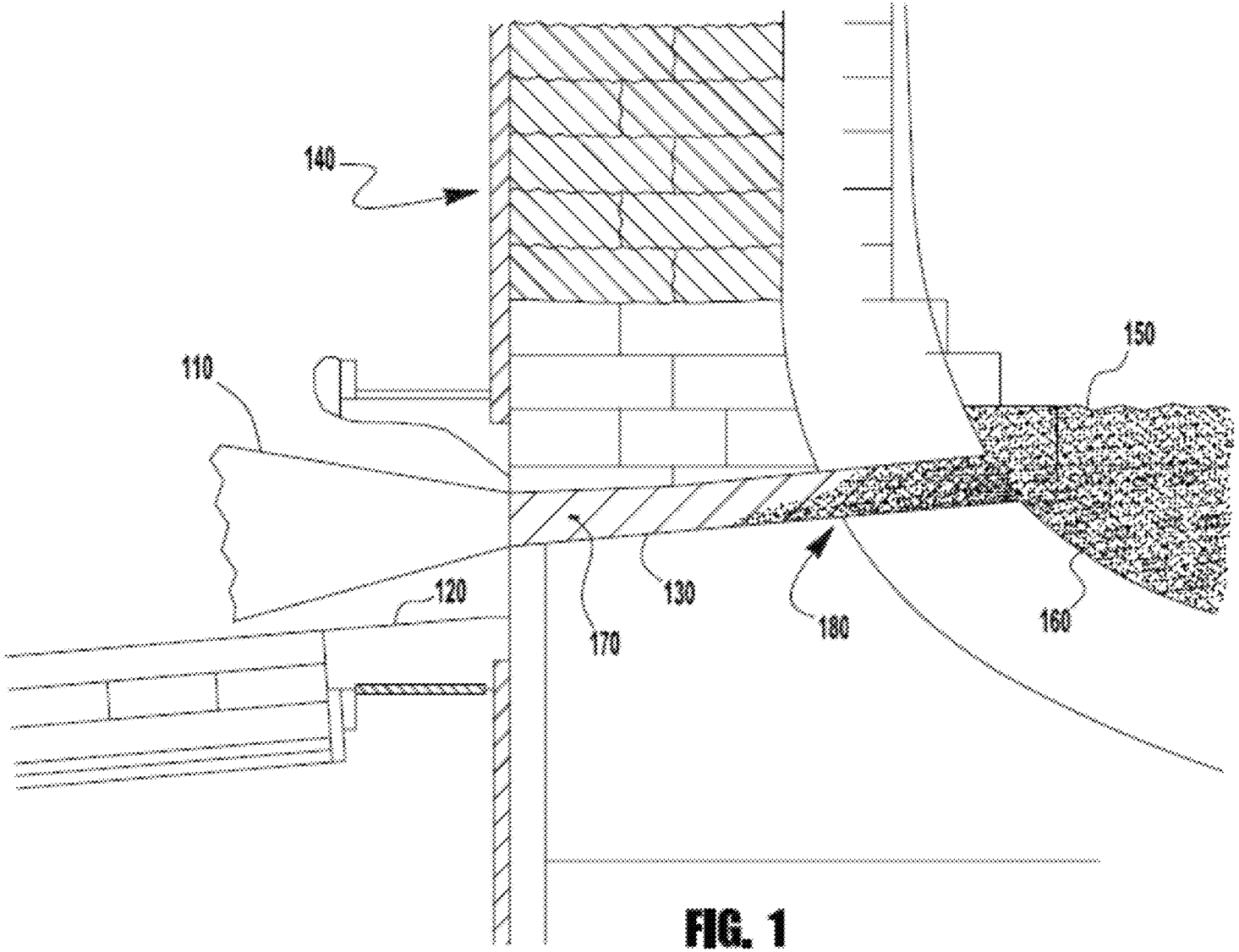
FIG. 1 PRIOR ART
FIG. 1 (Prior Art) is a cross-section of a portion of a blast furnace, a tap hole, a mud gun nozzle and a trough.

As the portion 550 is forced up through the tap hole 130 it acts as a barrier between the slag/molten iron 150/160 and the mud 170. In FIG. 7 the portion 550 is shown about half way up the tap hole 130. In FIG. 8 the tap hole 130 is filled with mud 170 and the portion 550 is shown near the end of the tap hole 130. In some embodiments, portion 550 at least partially prevents slag/molten iron 150/160 from remaining in the tap hole 130 and mixing with the mud 170 to form a mud and ore residue 180 (illustrated in FIG. 1). After the mud 170 dries or cures, the mud gun is rotated back into its resting position. The mud gun cap 200 either falls off on its own, or is knocked off by an operator.

In addition, since the tap hole 130 is now filled with mud 170 and contains less mud and ore residue 180, the tap hole drill (not shown) has an easier time drilling a clean hole in the tap hole 130 during subsequent tapping operations. This extends the life of the tap drill bit and allows for more precise control over the molten iron 160 flow rate.

FIG. 8 is an exemplary methodology 800 for making a mud gun cap. The exemplary methodology is by way of example only and is not meant to be limiting. In some embodiments, additional steps are performed. In some embodiments, not all of the steps are performed. In addition, the blocks need not be performed in the order shown and described and may be performed in different orders with additional steps or with fewer steps.

The exemplary methodology 800 begins at block 802 and at block 804 a mud gun cap mold is provided. A water bath is provided at block 806 and flame-resistant fibers are provided at block 808. At block 810 the flame-resistant fibers are drawn through the water bath into the mud gun cap mold. The mold is removed from the water bath and dried at block 812 and the methodology ends at block 814.

While the present invention has been illustrated by the description of embodiments thereof, and while the embodiments have been described in considerable detail, it is not the intention of the applicants to restrict or in any way limit the scope of the appended claims to such detail. Additional advantages and modifications will readily appear to those skilled in the art. For example, the outer face 210 may be perforated around the inside edge of the ring 220 allowing a cleaner tear as the mud 170 is forced through. Therefore, the invention, in its broader aspects, is not limited to the specific details, the representative apparatus, and illustrative examples shown and described. Accordingly, departures may be made from such details without departing from the spirit or scope of the applicant's general inventive concept.

I claim:

1. A mud gun cap comprising:

a flame-resistant body having fibers with a flame rating of at least 2600 degrees;

the flame-resistant body having a tap hole contacting surface;

the flame-resistant body having side walls;

a first bore located within the flame-resistant body;

a second bore located within the flame-resistant body;

the first bore having a first diameter and second bore having a second diameter, wherein the first diameter is smaller than the second diameter;

wherein the second bore is located farther away from the tap hole contacting surface than the first bore;

wherein the tap hole contacting surface contains one or more perforations to control braking of the surface.

2. The mud gun cap of claim 1 wherein the side walls are angled outward from the tap hole contacting surface.

3. The mud gun cap of claim 2 wherein the side walls are angled from between about 10 degrees to about 60 degrees.

4. The mud gun cap of claim 2 wherein the side walls are angled from between about 20 degrees to about 45 degrees.

5. The mud gun cap of claim 1 wherein the mud gun cap comprises at least a 2600 degree Fahrenheit fiber.

6. The mud gun cap of claim 1 wherein the fibers comprise a ceramic fiber.

7. A method of making a mud gun cap comprising:

providing a mud gun cap mold;

providing a water bath;

providing flame-resistant fibers;

drawing the flame-resistant fibers through the water bath into the mud gun cap mold;

removing the mud gun cap mold from the water bath;

drying the mud gun cap;

removing the mud gun cap from the mold and adding one or more perforations to a tap hole surface to control breaking of the tap hole surface.

8. A mud gun cap comprising:

a flame-resistant body;

the flame-resistant body having a tap hole contacting surface;

the flame-resistant body having side walls extending up from the contact surface at an angle of between about 15 degrees and about 50 degrees;

a first bore located within the flame-resistant body;

the first bore sized to fit over the tip of a mud gun nozzle;

Wherein the mud gun cap is a molded from flame-resistant fibers having a rating of at least about 2600° Fahrenheit;

wherein the tap hole contacting surface contains one or more perforations to control braking of the surface.

9. The mud gun cap of claim 8 further comprising a second bore located within the flame-resistant body;

the first bore having a first diameter and second bore having a second diameter, wherein the first diameter is smaller than the second diameter; and wherein the second bore is located farther away from the tap hole contacting surface than the first bore.

10. The mud gun cap of claim 8 wherein the side walls are angled outward from the tap hole contacting surface from between about 20 degrees to about 45 degrees.

11. The mud gun cap of claim 8 wherein the flame-resistant fibers are ceramic fibers.

* * * * *